United States Patent [19]

Cohen et al.

[11] Patent Number: 4,896,683

[45] Date of Patent: Jan. 30, 1990

[54] SELECTIVE DELIVERY AND RETENTION OF NICOTINE BY-PRODUCT FROM CIGARETTE SMOKE

[75] Inventors: Richmond R. Cohen, Hockessin, Del.; David J. Gibboni, Drexel Hill, Pa.

[73] Assignee: Hercules Incorporated, Wilmington, Del.

[21] Appl. No.: 258,366

[22] Filed: Oct. 17, 1988

[51] Int. Cl.[4] ..... A24D 3/06; A24D 3/08; A24D 3/16

[52] U.S. Cl. ..... 131/342; 131/343; 131/345; 131/331

[58] Field of Search ..... 131/334, 342, 343, 345, 131/331

[56] References Cited

U.S. PATENT DOCUMENTS

| | | | |
|---|---|---|---|
| 2,429,567 | 10/1947 | Sowa | 131/140 |
| 3,353,544 | 11/1967 | Fordyce et al. | 131/342 |
| 3,403,690 | 10/1968 | Horsewell | 131/267 |
| 3,428,055 | 2/1969 | Sublett et al. | 131/266 |
| 3,428,056 | 2/1969 | Sublett et al. | 131/267 |
| 3,434,479 | 3/1969 | Till et al. | 131/10.9 |
| 3,605,759 | 9/1971 | Owens et al. | 131/265 |
| 3,635,226 | 1/1972 | Horsewell et al. | 131/266 |
| 3,664,352 | 5/1972 | Norman et al. | 131/264 |
| 4,246,910 | 1/1981 | Radner et al. | 131/10.9 |

FOREIGN PATENT DOCUMENTS

| | | | |
|---|---|---|---|
| 1168354 | 10/1967 | United Kingdom | 131/342 |

*Primary Examiner*—V. Millin

*Attorney, Agent, or Firm*—John E. Crowe

[57] ABSTRACT

A method for controlling nicotine delivery through a cigarette filter relative to total particulate pass-through concentration, and the corresponding filter utilizing, as a filter modifier component, at least one water-soluble metal salt of a weak acid, the choice and amount of salt within the filter favoring an alkaline pH exceeding about pH 8, the amount of alkalinity being correlated to the desired amount of nicotine pass-through while corresponding nicotine filter retention properties are keyed to the presence and concentration of a water soluble salt of a strong acid within the filter.

22 Claims, 2 Drawing Sheets

SELECTIVE DELIVERY AND RETENTION OF NICOTINE BY-PRODUCT FROM CIGARETTE SMOKE

Figure 1:
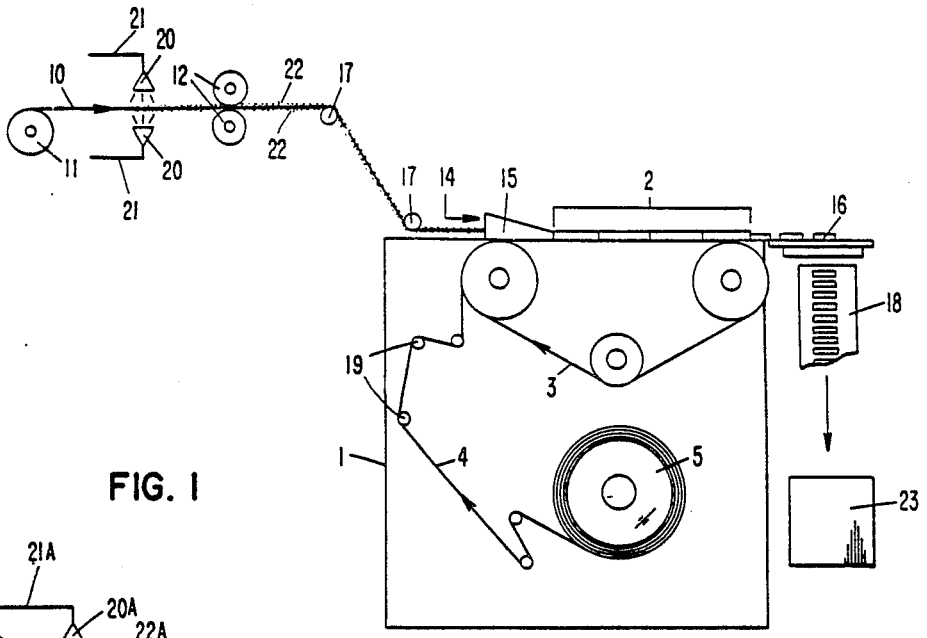

The present invention relates to an improved cigarette filter and method for selectively controlling nicotine delivery relative to delivered particulate matter from cigarette smoke by using a cigarette filter element containing at least one active water soluble modifier component.

BACKGROUND

Although fiber-based cigarette filter elements are well known and have been used for a number of years, the choice of components for this class of filters has remained quite limited over the years due to cost factors and lack of general suitability of many natural fibers for high speed filter production using state of the art filter rod-making apparatus. In addition, the demands on present day commercial cigarette filter elements tend to conflict, particularly with respect to general filtration efficiency and increased demand for selective filtration of cigarette smoke components.

While various fibers and fiber mixtures have been tried and evaluated, a substantial number of cigarette filter elements continue to favor old technology because of certain cost and handling advantages. For example, cellulose acetate tow can be readily processed into cuttable filter rods using an essentially unmodified state-of-the art filter rod-making apparatus without serious jamming problems. This advantage is enjoyed despite increased need for substantial amounts of additives, including organic plasticizers such as triacetin, diacetin, citric acid, as well as lubricants, flavors, medicines, selective filtering agents and the like. Generally, such additives are applied as aqueous solutions onto opened fiber tow by art-recognized dipping, spraying, or printing techniques.

The advantages of cellulose acetate fiber as filter substrate, however, are countered by certain disadvantages. For example, such fiber tends to be relatively weak compared with thermoplastic synthetics such as polyolefin fiber or filament. This characteristic seriously limits the amount of tension and crimp that a cellulose acetate fiber tow of low dpf will tolerate prior to introduction into a conventional filter rod-making apparatus.

Synthetics such as polyolefin fiber, however, also have some disadvantages. These arise from the fact that polyolefin substrates are generally hydrophobic and tend to be chemically inert, while a majority of known cigarette filter additives are hydrophilic. For this reason it is sometimes very difficult to apply and retain such additives in proper amount and functional condition within filter elements using hydrophobic synthetic fiber as a major substrate component.

Another problem, unique to the cigarette filter art, concerns the difficulty in optimizing fiber denier and general filter efficiency of synthetic fiber filters without corresponding sacrifice in dimensional stability, hardness, and pressure drop or draw across the filter element.

It is an object of the present invention to obtain cigarette filters of superior efficiency and draw which can be tailored to a wide variety of tobacco mixtures while retaining known advantages of various filter substrates or combinations thereof.

It is a further object of the present invention to control selectively both filter delivery and filter retention of nicotine by-product in cigarette smoke, compared with pass through concentrations of total particulate matter.

THE INVENTION

The above objects are obtained in accordance with the instant method for controlling nicotine filter retention and pass through characteristics of a cigarette filter element, comprising one or a combination of cellulose acetate- or thermoplastic synthetic- fiber substrate. These can include one or more substrates singly or in combination in the form of an (a) opened fiber tow, (b) ribbon of a nonwoven material, (c) sliver or (d) fibrillated film, which are activated by (A) treating one or more substrate of said filter element or plug component thereof with an aqueous solution or suspension containing an effective amount of a non-toxic water soluble salt of a weak acid as an active modifier; or (B) treating one or more substrate of said filter element or plug component thereof with an aqueous solution or suspension containing an effective amount of a non-toxic water soluble inorganic salt of a strong acid as an active modifier; and (C) completing fabrication of the desired cigarette, inclusive of drying the filter element; whereby (1) treatment of the substrate or plug component of the filter element with the salt of a weak acid increases filter pass through of nicotine smoke component relative to total particulate pass through concentration, and (2) treatment of the substrate or plug component of the filter element with the salt of a strong acid decreases filter pass through of nicotine smoke component relative to total particulate pass through concentration.

General filter efficiency, particularly solid particulate removal, depends substantially upon fiber denier, filter length and density, but selective filtration properties, particularly control over gassified flavor components, such as nicotine retention and pass through characteristics, are less easily predicted, and remain a continuing problem in the filter art.

The present invention relates to a way of more easily tailoring cigarette filters for specific tobacco mixtures and to satisfy taste and health demands in a rapidly changing market.

In particular, it is found that increased nicotine delivery or pass through is obtained by applying and utilizing one or more salt of a weak acid selected from carbonic, phosphoric, acetic, citric and fumaric acids, in the form of non-toxic water soluble metal salts of group 1(a), 2(a) and Transition Elements, preferably acetate, carbonate, or phosphate salts exemplified by $Mn(OAc)_2$, $Mg(OAc)_2$, $KHCO_3$, $K_2CO_3$, $Na_2CO_3$, $NaHCO_3$, $K_3PO_4$, $KHPO_4$ and $KH_2PO_4$. For such purposes, it is found particularly advantageous to apply the above salt solutions or suspensions onto one or more filter substrate in sufficient concentration to obtain a pH range of about pH 8 to about pH 12, and preferably about pH 8.0 to about pH 10.5.

Where the tobacco mixture requires increased filter retention to obtain a proper flavor balance, it is found that such retention can be selectively promoted, relative to total particulate pass through, without substantially changing fiber denier or filter density, by merely adding to one or more filter substrate an active amount of a non-toxic water-soluble metal salt of a strong mineral acid. Salts of hydrochloric, or hydrobromic acid are found useful for such purpose.

Active salts of the latter type include, for example, selected metal salts of group 1(a), 2(a) and Transition Elements, inclusive of calcium, potassium, zinc, lithium, and magnesium. Such salts specifically include, for instance, $ZnCl_2$, LiBr, KBr, $CaBr_2$, $MnCl_2$, and $MgCl_2$.

Salts of the above-defined types are individually applied, as needed, onto one or more appropriate fiber- or fibrillated film substrate(s) in a manner and in effective amounts as indicated hereafter.

Cigarette filter rods or elements within the scope of the present invention usefully comprise, in combination, (a) a filter plug of compacted substrate comprising one or more of cellulose acetate- or synthetic thermoplastic-fiber continuing substrate such as a fiber- or film forming polyolefin, polyester or polyamide;

(b) a plurality of active filter loci distributed within the compacted substrate, wherein the loci consist essentially of solid and/or solid/liquid phases of the desired water soluble salt of a strong or a weak acid and a nontoxic metal. While the loci may vary somewhat with storage, the preferred initial configuration consists of crystals or noncrystalline solids in conjunction with a small surrounding liquid phase in the form of a saturated or concentrated aqueous salt solution; and (c) a plug wrap such as paper or film securing the compacted substrate to form the rod and, ultimately, a filter element of desired nicotine retention or pass-through properties as above described.

Figure 2:
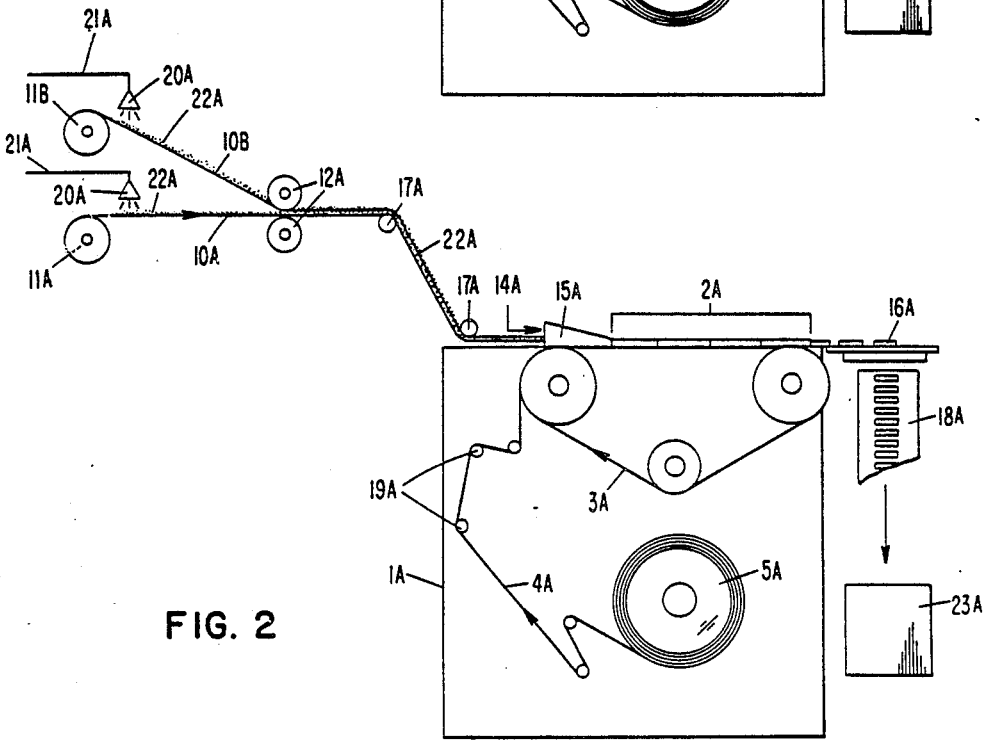
Figure 3:
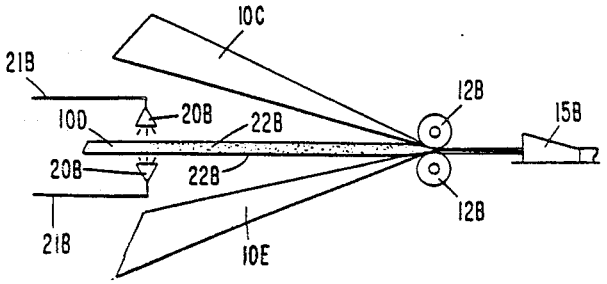

If desired, one or more active modifier salt component(s) can be applied onto separate filter substrate surfaces (ref. FIGS. 2-3), which are then introduced singly or in register as garniture feed into a filter rod-making apparatus. In such instance, application of active modifier salt component can be conveniently effected by spraying the garniture feed component, or a solution of the active modifier salt can be vacuum drawn through the resulting formed filter rod. In each case filter rod or element is oven dried under controlled heat and humidity before storage or direct combination with a tobacco plug to complete fabrication of the filter element.

An "effective amount of active modifier component", for purposes of the present invention, is an amount of the salt totaling about 2% by weight or more, and preferably about 3-10%, based on total weight of dry filter plug substrate. As above noted, the salt is best distributed in the form of a plurality of filter loci evenly distributed onto a filter substrate and dried to form solid or solid/liquid phases within the filter element.

Also included within the scope of the present invention are filter elements additionally containing surfactant material in a concentration of about 0.1%-10% and preferably 0.5%-10% by weight of one or more of a class described as (1) a polyoxyalkylene derivative of a sorbitan fatty acid ester, (2) a fatty acid monoester of a polyhydroxy-alcohol, or (3) a fatty acid diester of a polyhydroxy alcohol.

Suitable surfactants can include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, poly(oxyethylene-co-oxypropylene) and the like.

The term "substrate", as above defined, denotes a tow, sliver or web of fiber or fibrillated film usable as garniture feed for a filter rod- making apparatus, including one or more of an opened fiber tow of cellulose acetate fiber or thermoplastic synthetic fiber of mono-, bi- or tri-component fibers inclusive of side-by-side and sheath/core varieties having a sheath of lower melting point than the core. Webs of such feed, as above noted, are conveniently introduced into a garniture of a filter rod-making apparatus alone or in complete or partial register (see FIGS. 2 and 3).

Such garniture feed can conveniently include up to about four or more webs of substrate component(s) of a homogeneous or mixed variety, the desired active components being applied onto one or both faces of selected substrates, the manner and number of faces treated depending upon desired filter selectivity and efficiency, plus feel, hardness, and draw characteristics.

For purposes of the present invention, it is immaterial whether the garniture feed is fabricated, in situ, (i.e. immediately upstream of the garniture) or earlier produced and stored before use.

It is also found suitable to use one or more nonwoven fabrics of the same or different fiber composition and denier as garniture feed, particularly when not all of the substrate in the filter element is to be used as a carrier surface for active modifier component(s).

When a ribbon of a nonwoven fabric or a fiber tow is used as garniture feed component in accordance with the present invention, such can again usefully comprise up to about 100% by weight of cellulose acetate- or synthetic thermoplastic substrate and preferably 10%-100% by weight of polyolefin (mono , bi-, or tri-component) fiber of the side-by-side and sheath/core types, identified here as staple fiber, or may consist of webs or tows having filaments of homogeneous or mixed denier, or combination of fibers such as (a) polypropylene/polyethylene, polypropylene/polyvinylidene chloride, polypropylene/cellulose acetate, polypropylene/rayon, polypropylene/nylon, cellulose acetate/polyethylene, plasticized cellulose acetate, polypropylene/paper; or (b) polypropylene/polystyrene/polyethylene, and the like, in preferred ratios of about (a) 10%-90% 90% -10% or (b) 10%-90%/45%-5%/45%-5% based on fiber weight, and as described, for instance, in U.S. Pat. No. 3,393,685.

Fibrillated film can be employed as a substrate component for use alone or in combination with other substrate components as garniture feed within the present invention. Such can be obtained, for instance, in accordance with components disclosed in U.S. Pat. No. 4,310,594 (Yamazaki) and U.S. Pat. No. 3,576,931 (Chopra).

For present purposes, and as part of the step of completing fabrication of the desired filter element is the use of a conventional filter rod-making apparatus. Such device generally contains a tow trumpet, garniture, shaping means, wrapping means, and cutting means in accordance with components and processes described, for instance, in U.S. Pat. Nos. 3,144,023 and 2,794,480. If desired, however, modifications can be made to permit in-situ or prior spraying, dipping, printing, vacuum draw, or other traditional application methods for introducing one or more salt components of the present invention prior to or after the formation of a filter plug.

By way of further background, baled sliver or other garniture feed can, if desired, be continuously dip coated or feedably contacted using one or more printing roll(s) fed from reservoir(s) containing desired active components(s), and the fabrication step completed, as above noted, by conventional drying, using nip rolls, heated drying rolls, ovens, and the like. Suitable drying can occur at temperatures within the range of about 70° C.–125° C.

When desired, nonwoven material suitable for use as garniture feed is obtained from fiber of homogeneous or mixed denier, using art-recognized techniques. Preferably such nonwovens fall within a weight range of about 10–50 grams per $m^2$, and a ribbon width of about 4"–12" will generally assure successful passage through the garniture of a conventional filter rod-making apparatus operating at production speeds.

As above-noted, a suitable garniture feed may include about 1–4 or even more substrate webs of identical or different weight, dimensions, bonding properties, absorption properties, fiber composition, and denier. A plurality of such webs can be introduced wholly or partly in register and in machine, cross, or diagonal directions as desired. For best results, however, one relatively lightly thermally bonded fabric, tow, sliver or fibrillated film in register with one nonwoven fabric, or between two nonwoven fabrics (ref. FIG. 2) is found to offer good salt retention, filter draw, and hardness.

The inclusion of an additional low melting fiber such as polyethylene, combined with other polyolefin fiber as garniture feed is also found useful for obtaining tow plugs of widely varying bonding and adsorption properties.

Cost-wise, opened fiber tow and nonwoven ribbons are found to be an especially useful combination since they permit the use of relatively cheap polyolefin webs of mixed denier, and simplify the task of precise distribution of modifier salt components without the need for abandoning art-recognized techniques and equipment such as printing rolls and spray heads for substrate coating.

Supplemental components, in addition to the abovedefined active modifier salt components, can also be employed such as, for instance, aqueous solutions, emulsions, suspensions, or dispersions of one or more humectants, exemplified by polyhydric alcohols such as glycerols, glycols, etc.; flavors and perfumes such as ketoses and polysaccharides, including wintergreen, spearmint, peppermint, chocolate, licorice, cinnamon, fruit flavors, citrus etc.; medicines, such as menthol and decongestants, and other art-recognized additives as found in U.S. Pat. Nos. 4,485,828 and 4,715,390.

In order to maintain precise control over application of additives, it is found useful if the receiving substrate is carefully controlled and consistent with respect to moisture content before conversion into a filter element. In addition, a filter element and its applied additive components is usefully further isolated or shielded from direct contact with the lips by applying the active component onto a tow, sliver or nonwoven fabric which is, in turn, sandwiched between two or more untreated nonwoven fabrics of lesser permeability (Ref. FIG. 3). If desired, the resulting filter element can also be externally coated with cork or similar inert heat-insulating material (not shown). The amount and effectiveness of modifier(s) applied to filter elements in the above way is determined substantially by the substrate width and number of substrates which are fed simultaneously into a garniture, as well as the amount of treated surface exposed to cigarette smoke in the filter element.

For purposes of the present invention both treated and combinations of treated and untreated fabric ribbon, tow, and the like can be usefully wrapped using conventional plug wrap such as paper having a weight within a range of about 25–90 $g/m^2$ or higher, as desired.

Figure 4:
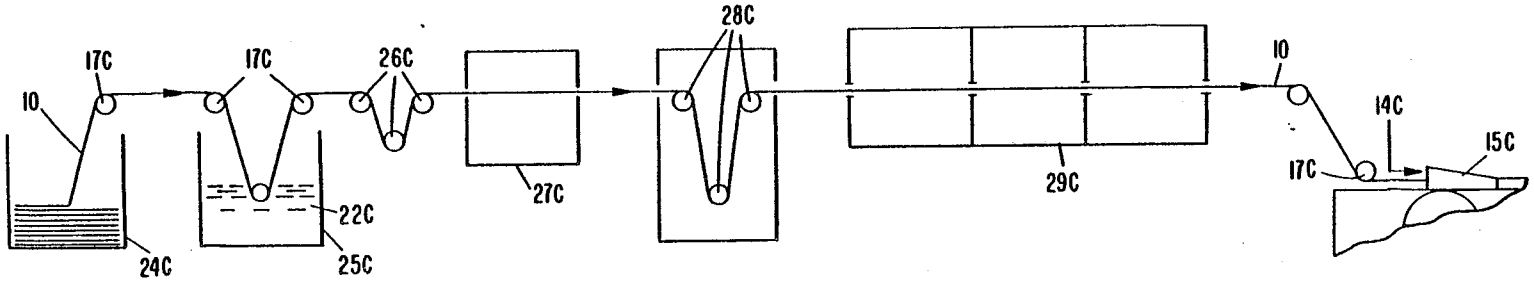

The instant invention is further illustrated in FIGS. 1–4, in which FIG. 1 diagrammatically represents a conventional cigarette filter rod-making apparatus capable of converting treated substrate in accordance with the instant invention, into cigarette filter elements; FIGS. 2–4 diagrammatically represent further modifications and improvements within the instant invention, whereby one or more tows, slivers, ribbons of nonwovens, and fibrillated film are treated with one or more active modifier components by spraying, dipping, or by vacuum draw of wrapped filter plug, the use of multiple substrates in this manner favoring increased filter element bulk and improved crush resistance, or hardness.

Referring to FIG. 1 in further detail, a single continuous substrate such as opened fiber tow, sliver, fibrillated film or ribbon of nonwoven fabric (10) is fed from feed reel (11) or a bale (not shown) and across one or more opposed spray heads (20) feedably connected to feed lines (21) from outside sources (not shown) to apply one or more active modifier component (22). The resulting treated substrate is then dried by air drying means (not shown) and by passing through drying rolls (12), to obtain the desired degree of dryness, and then led by guide rolls (17) into a garniture trumpet (15) and garniture (14) of a cigarette filter rod manufacturing apparatus (1), comprised of a garniture section (2) including (but not showing) means for shaping and retaining the substrate feed, wrapping means, and cutting means for converting the wrapped plug or rod into filter element (16); the wrapping means is conveniently supplied with tow wrap from wrap feed reel (5) supported by support rolls (19) and moved onto a continuous garniture belt (3) for introduction into the rod-making apparatus.

The apparatus, as described, comprises conventional means for sealing a tow wrap around a filter plug (not shown), the wrapped plug then being cut by cutting means into generally cylindrical filter elements (16) of desired length (normally 90 mm or more), which are removed through filter chute (18) (shown in fragment) for packing in container (23).

FIG. 2 diagrammatically demonstrates a further arrangement for separately applying one or more filter modifier salt component(s) or other additives onto substrates (10A) and (10B), whereby differently arranged spray heads (20A) fed by feed lines (21A), separately apply active modifier components (identical or otherwise) (22A) onto separate substrates (10A, 10B), which are then at least partially dried using air and heated rolls (12A), before being fed through garniture (14A) of rod-making apparatus (1A), to form filter elements (16A) as before. Substrates (10A and 10B), are fed from feed rolls (11A) and (11B) or bales (not shown) and conveniently brought into register at heated nip rolls (12A), then guided by guide rolls (17A) into garniture (14A), the garniture feed or substrate components shown being similarly defined by arabic numbers in each of FIGS. 1–3.

FIG. 3 diagrammatically demonstrates a further modification of the equipment and process of FIGS. 1 and 2, whereby several substrates of the same or different types (10C, 10D, and 10E) as described above from reels or boxes (not shown) are fed through a nip created by heated rolls (12B), the middle substrate (10D) preferably being of different width and having higher absorption or adsorption properties for retaining active components (22B) than the two external untreated substrates (10C and 10E). As shown, substrate (10D) is sprayed on both sides to selectively expose it to one or more active modifier components (22B) applied by spray heads (20B) fed from feedlines (21B), one substrate (10E) preferably being arranged so as to catch surplus drip or misdirected active components not retained or captured by ribbon (10D), all three substrates are then at least partially air dried by passing in register through heated nip rolls (12B), as before, and directed by guide rolls (not shown) into the garniture of a filter rod apparatus in the manner of FIGS. 1 and 2.

FIG. 4 is a diagrammatic representation of a further modification in which one or more substrates, as above defined, (shown as 10C) are separately fed from a bale or box (24C), passed over guide rolls (17C), and dipped into a reservoir (25C) containing one or more active modifier component(s) (22C) in solution, suspension, or emulsion, and then passed through nip rolls (26C), through a heating oven (27C), drawer rolls (28C), a three step drying oven (29C), then to garniture (14C) of a cigarette rod manufacturing apparatus in the manner of FIGS. 1–3, supra, or boxed and stored for future use.

Where a continuous fiber tow is used as a substrate component, preparation of the tow is conveniently carried out in the usual way by drawing the fiber from one or more creels through a fluid bulking or texturing jet (not shown in figures) and then handled as noted above.

Substrates which are employed in the above manner can usefully comprise a variety of synthetic filaments as noted above. Thus, it is possible to use polyesters, polyamides, acrylics, as well as polypropylene and the like. Due to its relatively low density, compared to other synthetic fiber-forming material and excellent spin properties, combinations of filament-forming copolymers of propylene with ethylene or other lower olefins monomers are particularly preferred as tow, nonwoven ribbon and fibrillated film material.

The bulk denier of a tow for carrying out the present invention can conveniently fall between about 2,000 and 10,000, and this substrate can be supplied as a crimped fiber from a single creel or bale, or a composite of several creels or bales combined and passed through a fluid jet simultaneously. For best performance of fiber tow as cigarette filters, however, it is preferred that at least some tow be substantially untwisted and untexturized prior to entering a fluid jet.

The invention is further illustrated by the following Examples.

EXAMPLE I (A) Baled 4.5 dpf "y" cross section polypropylene fiber obtained from melt spun isotactic polypropylene having a melt flow rate (MFR) of 16, is broken, opened, carded, crimped and pulled to form a thin tow of about 12—inches in width. This ribbon is drawn, without further treatment, through the garniture of a conventional filter rod-forming apparatus identified as model PM-2 obtained from Molins Ltd. of Great Britain; and the garniture feed is compressed to form filter plugs which are wrapped with BXT-100 polypropylene film to obtain 108 mm filter rods. The rods are then cut and sorted into 27 mm lengths of substantially equal weight, and draw*1, and taped onto R. J. Reynolds' Camel Light tobacco plugs, stored for 48 hours in a humidity cabinet at 55%–65% relative humidity at 22° C.*2, and then used as control samples group-wise identified as C-1 and C-2 and identically smoked down to 35 mm lengths in two second puffs per minute on a Borgwaldt smoking machine*3. The particulate matter in the resulting smoke is trapped in a preweighed Cambridge filter pad, and the pad reweighed to determine total and average particulate matter (TPM) passed through the cigarette filter. The Cambridge pad is then soaked overnight in anhydrous isopropyl alcohol, and the resulting extract conventionally tested for nicotine and water content using a GC (gas chromatograph) autosampler*4.

*1All tested filter elements have a resistance to draw (RID) within the range of 111–136 mm Wg (water gauge).
*2According to CORESTA Standard Method #10
*3Models RM 20/CS 20 and RM 1/G
*4Hewitt Packard Model HP5890

(B) Fiber tow from the same bale is identically processed to obtain ten test filter elements in the manner of Example 1A except that the cut filter elements are then treated with 1%, 2% and 5% solutions of $KHCO_3$, $K_2CO_3/KHCO_3$ mixed salts, $Mg(OAc)_2$, $Mn(OAc)_2$ and $MgCl_2$, respectively, using a suction bulb to draw up and impregnate each filter element with an amount of solution sufficient to treat in a uniform manner with about 20 mg. of modifier salt. The test filter elements are then air and oven dried, stored in a humidity cabinet for 48 hours, and then taped to an R. J. Reynolds' Camel Light tobacco plug as before. Conventional tests for nicotine, total particulate matter (TPM) and filter efficiency, are carried out as before, averaged on a per/-cigarette basis, and reported in Table I as S-1 through S-19.

TABLE I

| Sample | Solution | Conc (%) | pH | Nic/TPM (%) |
|---|---|---|---|---|
| S-1 | $KHCO_3$ | 2 | 8.20 | 6.86 |
| S-2 | $KHCO_3$ | 1 | 8.20 | 7.72 |
| S-3 | $KHCO_3$ | 2 | 8.31 | 6.65 |
| S-4 | $KHCO_3$ | 5 | 8.47 | 9.41 |
| S-5 | $KHCO_3$ | 1 | 8.53 | 9.33 |
| S-6 | $KHCO_3$ | 5 | 8.74 | 6.36 |
| S-7 | $K_2CO_3/KHCO_3(1/4)$*5 | 5 | 9.00 | 6.90 |
| S-8 | $K_2CO_3/KHCO_3(1/1)$ | 5 | 9.50 | 6.99 |
| S-9 | $K_2CO_3/KHCO_3(1/1)$ | 5 | 9.58 | 6.66 |
| S-10 | $K_2CO_3/KHCO_3(4/1)$ | 5 | 10.10 | 8.45 |
| S-11 | $K_2CO_3/KHCO_3(4/1)$ | 5 | 10.40 | 8.90 |
| S-12 | $K_2CO_3$ | 2 | 11.50 | 8.20 |
| S-13 | $K_2CO_3$ | 5 | 11.80 | 8.10 |
| S-14 | $Mg(OAc)_2$ | 2 | 8.21 | 8.73 |
| S-15 | $Mg(OAc)_2$ | 5 | 8.13 | 7.02 |
| S-16 | $Mg(OAc)_2$ | 2 | 7.65 | 8.66 |
| S-17 | $Mg(OAc)_2$ | 5 | 7.68 | 6.84 |
| S-18 | $MgCl_2$*6 | 2 | 9.38 | 3.19 |
| S-19 | $MgCl_2$ | 5 | 9.09 | 4.87 |
| C-1 | | — | 7.00 | 5.14 |

*5in parts by weight.
*62 a strong acid salt.

EXAMPLE II

Fiber tow from the same bale as Example I is identically processed to obtain filter elements, except that the cut elements (identified as S-20 through S-24) are impregnated with $K_3PO_4$ and $K_2HPO_4$ solutions to obtain effective concentrations of active salt equal to about 20 mg/filter element. The resulting treated and dried filter elements are taped to R. J. Reynolds' Light tobacco plugs, as before, air dried, and stored in a humidity cabinet for 48 hours, before smoking in an identical manner. The samples are collected and tests run as before, average results being reported in Table II below.

TABLE II

| Sample | Solution | Conc (%) | pH | Nic/TPM | TDR |
|---|---|---|---|---|---|
| S-20 | $K_3PO_4$ | 5 | 11.7 | 7.7 | 30.4 |
| S-21 | $K_3PO_4/K_2HPO_4$ (1/1) | 5 | 11.0 | 7.2 | 36.3 — |
| S-22 | $K_3PO_4/K_2HPO_4$ (1/8) | 5 | 10.1 | 8.2 | 29.8 |
| S-23 | $K_2HPO_4$ | 5 | 9.0 | 7.0 | 35.5 |
| S-24 | $KH_2PO_4$ | 5 | 4.4 | 5.8 | 36.4 |
| C-2 | — | — | — | 5.5 | 35.9 |

What is claimed:

1. A method for controlling nicotine filter retention and pass through characteristics of a cigarette filter element comprising one or a combination of cellulose acetate- or thermoplastic synthetic- substrate, comprising, A. treating one or more fiber of film substrate forming said filter element or plug component, thereof with an aqueous solution or suspension having a pH within a range of about pH 8 to about pH 12 and containing an effective amount of a non-toxic water soluble salt of a weak acid as an active modifier; or B. treating one or more fiber or film substrate forming said filter element or plug component thereof with an aqueous solution or suspension containing an effective amount of a non-toxic water soluble inorganic salt of a strong acid as an active modifier; and C. completing fabrication of the desired filter element;

whereby (1) treatment of said substrate or plug component of the filter element with the salt of a weak acid increases filter pass through of nicotine smoke component relative to total particulate pass through concentration, and (2) treatment of said substrate or plug component of the filter element with the salt of a strong acid decreases filter pass through of nicotine smoke component relative to total particulate pass through concentration.

2. The method of claim 1 wherein the non-toxic water soluble metal salt of acid is applied to one or more substrate of said filter element or plug thereof as a buffered solution or suspension having a pH within a range of about pH 8 to about pH 12.

3. The method of claim 2 wherein the pH range of said buffered solution or suspension is from about pH 8.0 to about pH 10.5.

4. The method of claim 2, wherein said substrate comprises thermoplastic synthetic fiber, and said aqueous solution or suspension comprises at least one non-toxic metal salt of an acid selected from the group consisting of carbonic, phosphoric, acetic, citric, and fumaric acid.

5. The method of claim 4, wherein the non-toxic metal salt is a member selected from the group consisting of at least one of $Mg(OAc)_2$, $Mn(OAc)_2$, $KHCO_3$, $K_2CO_3/KHCO_3$, $NaHCO_3$, $KHPO_4$, and $KH_2PO_4$.

6. The method of claim 1, wherein said aqueous solution or suspension contains at least one non-toxic metal salt of an acid selected for the group consisting of hydrochloric and hydrobromic acid.

7. The method of claim 6 wherein the non-toxic metal salt is at least one member selected from the group consisting of $ZnCl_2$, LiBr, KBr, $CaBr_2$ and $MgCl_2$.

8. The method of claim 1, wherein the cigarette filter element comprises up to 100% by weight of cellulose acetate.

9. The method of claim 1, wherein the substrate of the cigarette filter comprises up to 100% by weight of synthetic thermoplastic substrate.

10. The method of claim 9 wherein the cigarette filter comprises up to 100% by weight of a polyolefin.

11. A cigarette filter rod or element comprising, in combination, (a) a filter plug of compacted substrate comprising one or more of cellulose acetate- or synthetic thermoplastic-fiber containing substrate;

(b) a plurality of active filter loci distributed within said compacted substrate; said loci consisting essentially of solid and/or solid/liquid phases of the desired water soluble salt of a strong or a weak acid and a nontoxic metal; and (c) a plug wrap securing said compacted substrate; whereby the presence of filter loci comprising the nontoxic water soluble salt of a weak acid favor filter pass through of nicotine relative to total particulate filter pass through concentration, and the presence of filter loci comprising the nontoxic water soluble salt of a strong acid favor filter retention of nicotine, relative to total particulate filter pass through concentration.

12. A cigarette filter rod or element of claim 11 wherein said active filter loci consist essentially of solid/liquid phases of a nontoxic water soluble salt of a weak acid, said liquid phase having a pH within a range of about pH 8 to about pH 12.

13. A cigarette filter of claim 11 wherein the water soluble salt is a non-toxic metal salt of an acid selected from the group consisting of acetic, carbonic, phosphoric, citric and fumaric acid.

14. A cigarette filter element of claim 13 wherein the water soluble salt is at least one of $Mg(OAc)_2$, $Mn(OAc)_2$, $KHCO_3$, $K_2CO_3$ and $NaHCO_3$.

15. A cigarette filter element of claim 11 wherein the water soluble salt is at least one of $MgCl_2$, LiBr, $CaCl_2$ and $CaBr_2$.

16. A cigarette utilizing as filter element the element defined in claim 11.

17. A cigarette utilizing as filter element the element defined in claim 12.

18. A cigarette utilizing as filter element the element defined in claim 13.

19. A cigarette utilizing as filter element the element defined in claim 14.

20. A cigarette utilizing as filter element the element defined in claim 15.

21. A method for controlling nicotine filter retention and pass through characteristics of a cigarette filter element comprising one or a combination of cellulose acetate- and thermoplastic synthetic-substrate, comprising, treating one or more substrate consisting of an open fiber tow, a ribbon of a nonwoven material, a sliver, and a fibrillated film with a buffered aqueous solution or suspension having a pH within a range of about pH 8 to about pH 12, said solution or suspension containing an effective amount of a non-toxic water soluble salt of a weak acid as active modifier; and completing fabrication of the desired filter element; whereby treatment of said substrate or plug component of the filter element with the salt of a weak acid increase filter pass through of nicotine smoke component relative to total particulate pass through concentration.

22. A cigarette filter rod or element comprising, in combination, (a) a filter plug of compacted substrate comprising one or more of cellulose acetate- or synthetic thermoplastic-substrate in the form of at least one of an opened fiber tow, a ribbon of nonwoven material, a sliver, and a fibrillated film;

(b) a plurality of active filter loci distributed within said compacted substrate, said loci consisting essentially of solid and/or solid/liquid phases of desired nontoxic water water soluble salt of a strong or a weak acid; and (c) a plug wrap securing said compacted substrate; whereby the presence of filter loci, comprising said nontoxic water soluble salt of a weak acid, favors filter pass through of nicotine relative to total particulate filter pass through concentration, and the presence of filter loci comprising the nontoxic water soluble salt of a strong acid favors filter retention of nicotine relative to total particulate filter pass through concentration.

* * * * *

UNITED STATES PATENT AND TRADEMARK OFFICE

CERTIFICATE OF CORRECTION

PATENT NO. : 4,896,683

DATED : JANUARY 30, 1990

INVENTOR(S) : COHEN & GIBBONI

It is certified that error appears in the above-identified patent and that said Letters Patent is hereby corrected as shown below:

Column 1, Line 31

"state-of-the art" should read --state-of-the-art--

Column 4, Line 31

"(mono , bi-, or..." should read --(mono-, bi-, or...--

Column 4, Line 42

"(b) 10%-90%/4-" should read --(b) 10%-90%/--

Column 4, Line 43

"5%-5%/45%-5%" should read --45%-5%/45%-5%--

Signed and Sealed this

Sixteenth Day of April, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,896,683

DATED : JANUARY 30, 1990

INVENTOR(S) : COHEN & GIBBONI

It is certified that error appears in the above-identified patent and that said Letters Patent is hereby corrected as shown below:

Column 5, Lines 37-38

"abo-vedefined" should read --above-defined--

Column 7, Line 56

"12--inches" should read --12-14 inches--

Column 8, Line 54

"*$^{6}$2 a strong acid salt." should read

--*$^{6}$ a strong acid salt.--

Column 9, Line 18

"fiber of film" should read --fiber or film--.